United States Patent [19]

Sturm et al.

[11] 4,082,121

[45] Apr. 4, 1978

[54] LIQUID DISPENSER WITH MEANS FOR AUTOMATICALLY PURGING AIR THEREFROM DURING LIQUID LOADING

[75] Inventors: Ronald Leo Sturm, San Carlos; James Curtis Smith, Hayward, both of Calif.

[73] Assignee: Oxford Laboratories Inc., Foster City, Calif.

[21] Appl. No.: 717,745

[22] Filed: Aug. 25, 1976

[51] Int. Cl.[2] ..... B65B 3/12

[52] U.S. Cl. ..... 141/27; 73/425.6; 128/218 C; 222/391; 417/435

[58] Field of Search ..... 141/2, 18, 25, 26, 27, 141/28, 44–49, 59, 29; 417/435; 128/214 R, 215, 218 P, 218 R, 218 C, 234, 236; 222/318, 391; 73/425.6, 425.4 P

[56] References Cited

U.S. PATENT DOCUMENTS 3,023,936 3/1962 Marsh et al. ..... 222/318

*Primary Examiner*—Houston S. Bell

*Attorney, Agent, or Firm*—Limbach, Limbach & Sutton

[57] ABSTRACT

A hand-held liquid dispenser of the type using a piston and piston cylinder for precise dispensing of desired volumes of liquid, including an improvement that automatically eliminates any air from the piston cylinder when an operator normally fills the piston cylinder with the desired liquid. A second piston of larger diameter than the first is disposed to draw fluid through the piston chamber at a much faster rate during a first short segment of an intake stroke than would the first piston, thereby to exhaust all dead air from the cylinder and fill it entirely with liquid.

13 Claims, 7 Drawing Figures

LIQUID DISPENSER WITH MEANS FOR AUTOMATICALLY PURGING AIR THEREFROM DURING LIQUID LOADING

BACKGROUND OF THE INVENTION

This invention relates generally to liquid handling devices, and more particularly to improvements therein for loading of liquid.

Liquid handling devices of various specific types are presently used in many forms and applications. An usual basic structure found in such devices is a piston chamber and a piston which, when reciprocated, either draws fluid into the piston chamber or discharges it therefrom. Many such instruments are small and hand-held, and have attached thereto a needle or some other liquid receptacle through which liquid is drawn and discharged upon operation of the piston. The loading of liquid into the piston chamber of such devices presently results in air being drawn in as well since the piston is not immediately in contact with the liquid being loaded. An air space exists within the piston chamber and between the piston and the liquid to be loaded. This air remains after the desired liquid is drawn into the device.

In liquid transfer or dispensing device, such as the type used most frequently in chemical and medical laboratories, this air has to be taken into account in designing the device since the air trapped therein is compressible. This air thus affects the amount of liquid dispensed upon a given movement of the piston. Although the air interface is of no concern for many applications, it is desirable for precision applications that the air be eliminated before use.

Another commonly used liquid dispensing device is a medical syringe for inoculating animals and humans. Air must be eliminated from such a device prior to inoculation. The air is presently eliminated after filling by turning the syringe with its needle extending upright and displacing volume within the piston chamber until all of the air is expelled. This is awkward and requires a separate air purging manipulation.

It is, therefore, a principal object of the present invention to provide an improved technique and structure for purging air from liquid handling devices before use.

SUMMARY OF THE INVENTION

Briefly, the improved air purging technique of the present invention includes the use of the structure built into the liquid handling device for automatically purging air from the piston chamber as the piston is retracted during loading of liquid into the device. An operator of the instrument need not perform any separate step to purge the air from the device prior to use in dispensing liquid. Nor does the instrument have to be disassembled in order to fill it with liquid.

In a preferred form of the invention, as described in detail hereinafter, a second piston of a larger diameter than the main piston is axially attached thereto. Separate seals are provided for each of the pistons and are arranged at one end of the piston chamber so that when the piston assembly is initially withdrawn the larger piston operates with its greater fluid displacement to draw fluid into the chamber until it first fills with the liquid. In order to avoid spillage of liquid, it is provided that the main piston seals to the piston chamber just as the piston chamber is filled with liquid. The remainder of the filling operation occurs as normal in present devices.

Additional objects, advantages and features of the present invention will become apparent from the following description of a preferred embodiment thereof which should be taken in conjunction with the accompanying drawings.

DESCRIPTION OF A PREFERRED EMBODIMENT

Figure 1:
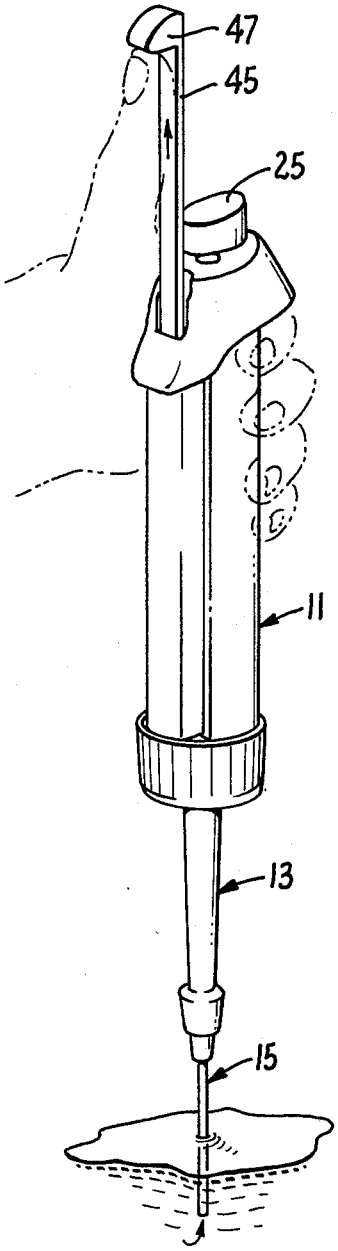
FIG. 1 shows the liquid loading operation of a hand-held precision incremental liquid dispensing instrument in which the air purging technique of the present invention is usefully incorporated.
Figure 2:
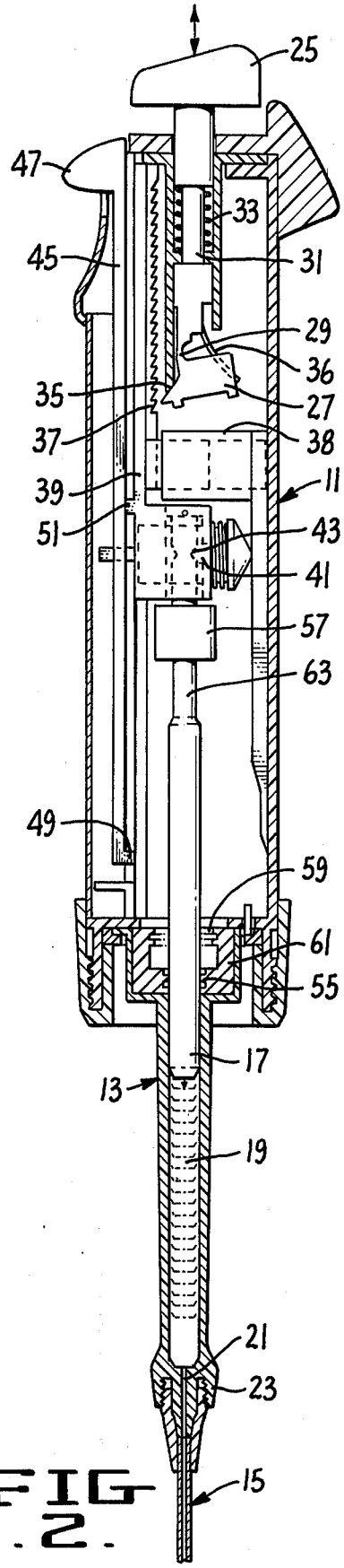
FIG. 2 is a cross-sectional view of the instrument of FIG. 1.
Figure 3:
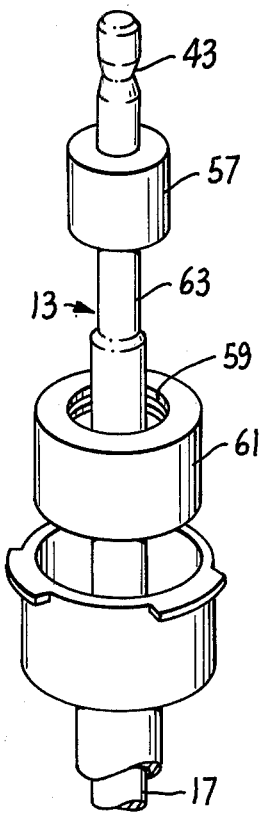
FIG. 3 is an exploded view of a few of the components of the device of FIGS. 1 and 2 that are utilized in carrying out the present invention.

With reference principally to FIGS. 1 and 2, the overall operation of the liquid dispensing device in which the present invention finds utility will be generally described. An elongated handle 11 contains most of the operating parts of the liquid dispensing device. A piston assembly 13 is removably attached to the bottom end of the handle assembly 11. A needle 15 is further removably attached to the bottom end of the piston assembly 13. A cylindrical piston 17 freely slides back and forth within a piston chamber 19, these two elements being major components of the piston assembly 13. A narrow fluid passage 21 extends through a needle lock adapter 23 at the lower end of the piston chamber 19. A similar passage within the needle 15, when the needle is appropriately locked onto the adapter 23, provides a continuation of the passage 21 to the needle tip for discharge and intake of liquid therethrough.

The piston 17 is incrementally advanced downward for dispensing liquid upon operation by manual depression of a knob 25 at an upper end of the handle 11. Operably attached to the knob 25 through a rod 31 is a pawl element 27. The pawl 27 is held by a hinge 29. The assembly is normally resiliently held by a spring 33 in its upper position but when the knob 25 is depressed, the pawl 27 is pushed beyond a cam surface 35 and thence urged by a spring 36 to engage a tooth of a rack 37. The result is to advance the rack downward a distance equal to the spacing between the teeth of the rack. A surface 38 serves to limit the downward travel of the pawl assembly. The rack itself is attached to a support slide 39. The piston assembly 13 is removably held at the lower end of the support slide 39 by a pin 41 which is normally inserted into a V-notch 43 at the upper end of the piston assembly.

Figure 5:
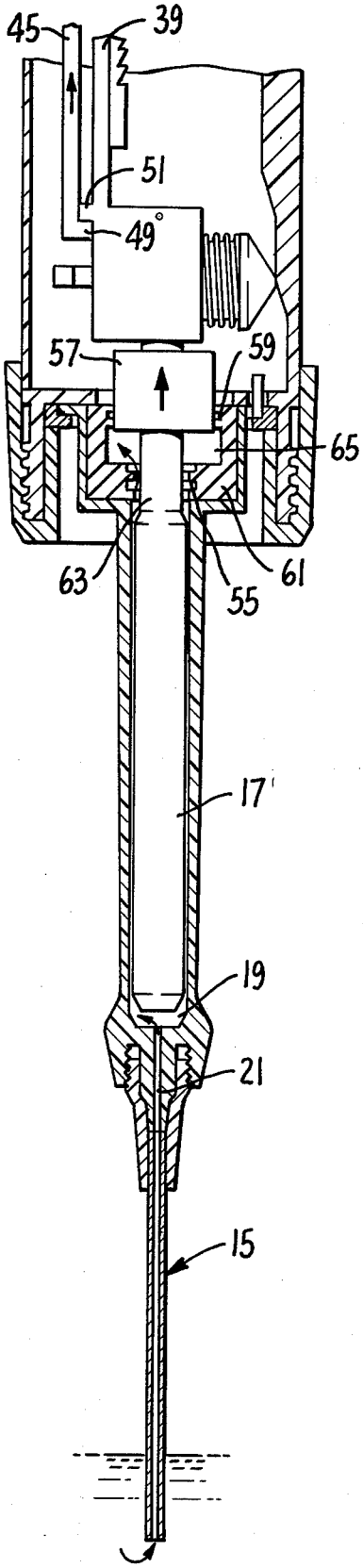
Figure 6:
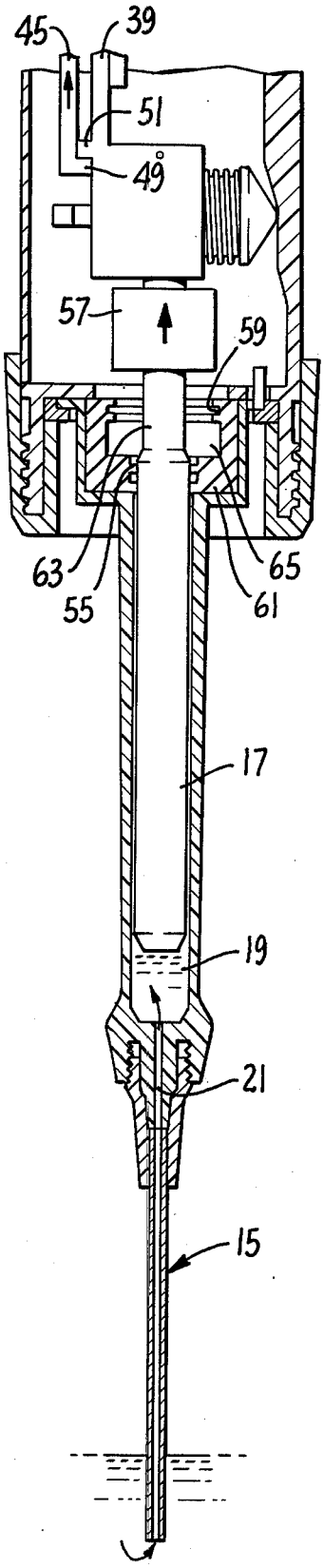

Each time the knob 25 is depressed, the piston 17 moves within the piston chamber 19 a small incremental distance, thus discharging through the needle 15 a predetermined amount of liquid. After the piston assembly and rack 37 have been moved all the way down so that the pawl has engaged the upper most tooth of the rack 37, the device must again be filled with liquid. This is accomplished as illustrated in FIG. 1 by immersing the needle 15 in a volume of liquid. A slide 45, having a knob 47 at its upper end, is pulled upward out of the housing 11. A hook 49 at the bottom of the slide 45 engages a protrustion 51 on a backside of the slide 39 and thus repositions the rack and piston to the position shown in FIG. 2. The cooperation of the loading slide 45 and the rack supporting slide 39 are also shown in FIGS. 5 and 6. The operating mechanism within the handle 11 is also described in more detail and claimed in another application being filed by Ronald Sturm and James Smith, entitled "Hand-Held Pipette for Repetitively Dispensing Precise Volumes of Liquid."

Figure 4:
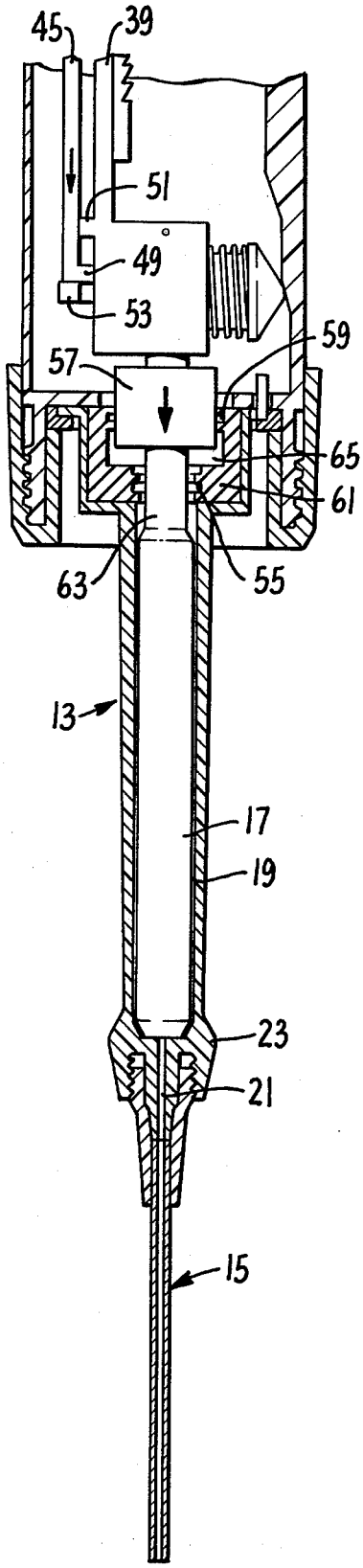
FIGS. 4, 5 and 6 illustrate in sectional view the lower portion of the instrument of FIGS. 1–3 with certain of its components in various different operating positions.

Loading of liquid in this matter is quite satisfactory when the same liquid is to be dispensed during the next operation. But in the event that the device is to be used with a different liquid, or in the event that a new piston assembly 13 is attached, there is air within the piston chamber 19, the passage 21 and needle 15 that will stay in the system unless purged in some manner. Referring to FIG. 4, a second protrustion 53 attached to the rack support slide 39 provides an abuttment for the loading slide 45 to urge the piston 17 downward a maximum amount to an overshoot position (Shown in FIG. 4). This minimizes the volume of dead air within the piston chamber 19.

Such purging is accomplished according to the present invention simultaneously with the filling operation. During the initial portion of the filling stroke, as illustrated in FIG. 5, a second piston 57 is permitted to operate to draw fluid into the piston chamber. The second piston 57 is of a much greater diameter than the main piston 17 and cooperates with its own circular seal 59. The circular seals 55 and 59 are axially aligned as part of a resilient, rubbery seal boot 61. The second piston 57 is axially aligned with the main piston 57 by a connecting segment 63 that has a cross-sectional area significantly less than that of the main piston 17. Air may thus be drawn from the piston chamber 19 through the circular opening of the seal 55 upon operation of the second piston 57 when the connecting segment 63 is positioned within the opening of the seal 55, as shown in FIG. 5. For convenience, the connecting segment 63 is also cylindrical in cross-sectional shape but it need not necessarily be. The cylindrical pistons 17 and 57 and the circular seals 55 and 59 all share a common center axis.

As shown in FIG. 5, withdrawal of the piston assembly from the piston chamber 19 causes fluid to be drawn up into the needle 15 through its passage with the undesired air being drawn into a chamber 65 at the opposite end and outside of the piston chamber 19. In order to avoid liquid spillage into that chamber 65, it is desirable that the seal of the main piston 17 take place just as the liquid being drawn in by the piston 57 reaches the bottom of the main piston seal 55. All of the air is thus purged by the time the main piston 17 forms a fluid tight seal with the seal 55. Further withdrawal of the piston assembly from the piston chamber 19 (as shown in FIG. 6) simply operates in a normal manner with additional liquid being drawn into the piston chamber to fill up the volume displaced by withdrawal of the main piston 17.

In order to purge the device of air in such an optimal manner, the size of the piston 57 and axial spacing of the two pistons 17 and 57 and axial spacing of their respective seals 55 and 59 should be such that the air volume displacement of the piston 57 from the overshoot position of FIG. 4 to the position wherein the main piston 17 first makes a fluid tight seal with the seal 55 should be substantially equal to or slightly greater than the air volume within the piston chamber 19 below the seal 55 plus that within the passage 21 and the needle 15.

The axial spacing of the two pistons 17 and 57 and their respective seals 55 and 59 should be such that at substantially the same time that the top portion of the main piston 17 first forms a fluid tight seal with its seal 55 the seal between the piston 57 and its sealing surface 59 is broken. Also, one seal or the other must be made at all times since a simultaneous break in both seals during the loading operation will undesirably cause liquid to flow back down out of the piston chamber and more air to be reintroduced into the piston cylinder.

Referring to any of FIGS. 4–6, the particular preferred structure of the seals 55 and 59 may be illustrated. Each of these seals includes two concentrically oriented, cylindrically shaped sealing surfaces that are axially separated by a void. The space or void between the two sealing surfaces of the piston seal 65 acts to store any small amounts of liquid spill-over that might occur, thus keeping the liquid from getting into the instrument itself.

Figure 7:
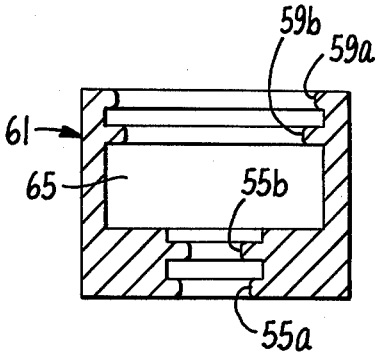
FIG. 7 is an enlarged cross-sectional view of a component of the instrument shown in FIGS. 1–6.

FIG. 7 illustrates the seal boot 61 in an enlarged form to show features of the sealing surfaces not visible from the other illustrations. The main piston seal 55 includes sealing lobes **55*a* and 55*b* of different diameters. The inner most sealing surface 55*b* is of the smaller diameter to exert a stronger squeeze against the piston 17 than does the outer most sealing lobe 55*a***.

Similarly, the seal 59 is made of two surface lobes **59*a* and 59*b*. The inner most surface lobe 59*b* is of a smaller diameter to more tightly squeeze against the larger piston 57 than does the lobe 59*a*. This arrangement of different sized sealing lobes prevents excess drag upon the piston assembly as it is withdrawn through the sealing boot 61 upon filling of the chamber 19 with liquid. Furthermore, there is no rapid change in the drag upon the piston as it is withdrawn through the seal 61**.

Although the present invention has been described with respect to a preferred embodiment thereof, it will be understood that the invention is entitled to protection within the full scope of the appended claims.

We claim:

1. In a liquid dispensing device that includes a piston chamber having a passage at one end for fluid flow therethrough into and out of said chamber, and a piston entering the chamber from its other end but not capable of entering said passage, means providing a fluid tight seal between said chamber and said piston, whereby movement of the piston within the piston chamber moved fluid through its said passage, an improvement for purging air from the piston chamber while it is being filled with liquid, comprising means automatically operable when the piston is moved in said piston chamber in a direction away from its said one end for withdrawing air from said piston chamber and said passage through said chamber's other end while simultaneously drawing liquid into the chamber at its said one end from a liquid source in response to fluid displacement within the chamber of the withdrawing piston, whereby a volume of air interface between said piston and said liquid source is eliminated during the same piston stroke that draws liquid into the piston chamber and passage.

2. The improved liquid dispensing device according to claim 1 wherein said air withdrawing means includes a second piston in fluid communication with said piston chamber and of a much larger cross-sectional area than said first piston, and means for simultaneously moving said first and second pistons relative to the piston chamber.

3. In a liquid dispensing device including a main cylindrically shaped piston chamber having a passage at one end for fluid flow therethrough, a main cylindrically shaped piston entering the cylinder from its other end, a circular seal positioned at said other end of the cylinder in a manner to provide a fluid tight seal between said piston and said cylinder, and means attached to said device adjacent said one piston cylinder end for receiving a receptacle with an opening in fluid communication with the piston cylinder, whereby movement of the piston within said piston cylinder causes fluid to move between said piston cylinder and the outside through said receptacle opening, an improvement for purging air from the piston chamber while it is being filled with liquid through said chamber passage, comprising:

a second cylindrically shaped piston attached to said main piston and axially aligned therewith by a segment having a cross-sectional area smaller than that of said main piston, whereby fluid may flow through said cylinder seal when said segment is positioned therein, a second seal disposed a distance away from said another end of the main cylinder and axially aligned with said cylinder seal, said second seal shaped to be engaged by the second piston in a fluid tight manner, said cylinder seal and said second seal being positioned at opposite ends of a fluid tight chamber, said pistons and seals being provided with relative sizes and axial positions so that when said cylinder piston is drawn away from an extreme position toward said one end of the cylinder the second piston draws all of the air out of the main chamber and the receptacle passage by the time that the main piston makes a fluid tight seal with said cylinder seal, whereby all air is purged from the cylinder and receptacle leaving nothing but the desired liquid therein.

4. An improved liquid dispensing device capable of automatically purging air therefrom while being filled with liquid, comprising:

a cylindrically shaped piston chamber, means provided at one end of said piston chamber for fluid to flow into and out of said chamber, a piston assembly, comprising:

a first elongated cylindrical piston segment at one end of said assembly having a diameter only slightly less than the internal diameter of said piston chamber for free reciprocation therein, and a second cylindrical piston segment of larger diameter axially connected to the first segment by a connecting portion that has a smaller cross-sectional extent than the first piston segment, a fluid sealing structure, comprising:

a first circular seal having a diameter for surrounding said first piston segment in a fluid tight manner, said seal being attached to another end of said piston chamber and axially aligned therewith, and a second circular seal having a diameter adapted to engage the outside surface of said second piston segment in a fluid tight manner, said second seal being held axially aligned with said first seal and said piston cylinder but a distance axially removed therefrom, said first and second seals being held with a fluid tight chamber therebetween except for the openings in said seals, said piston assembly being positioned for reciprocation in said piston cylinder and said sealing structure, said seals and said piston segments being relatively axially displaced from one another so that when the piston assembly is inserted a maximum amount toward said one end of the piston chamber that the second piston is within the second seal while said connecting segment of said piston is positioned within said first seal in a non-sealing relationship therewith, and the diameter of said second piston and the distance between said first and second pistons and between said first and second seals being such that upon withdrawal of the piston assembly from the piston cylinder all of the dead air therein is withdrawn prior to the first piston segment sealing with the first seal, whereby liquid is drawn into said cylinder through its said fluid flow means at its said one end while all undesired air is automatically purged therefrom at said another end.

5. The liquid dispensing device according to claim 4 wherein said first and second piston segments and said first and second seals are further axially displaced with respect to one another, respectively, so that as the piston assembly is withdrawn from the piston chamber the first piston segment makes its seal with said first seal substantially simultaneously with the second piston segment withdrawing from engagement with said second seal.

6. The liquid dispensing device according to claim 4 wherein said fluid flow means at one end of said chamber includes a detachable receptable having a fluid passage therein.

7. A liquid dispensing device capable of automatically purging air therefrom while being filled with liquid, comprising:

a chamber having a passage thereinto to enable fluid flow into and out of the chamber, means operatively held within the piston chamber in a fluid tight manner for controlling the fluid volume of the chamber, thereby to cause liquid to be drawn into the chamber through said passage when said controlling means expands the fluid volume of said chamber and said passage is connected to a source of liquid, a controllable opening into said chamber separate from said passage, thereby providing a path for purging any air from said chamber and passage, and means responsive to said fluid volume controlling means expanding the fluid volume of said chamber for simultaneously holding open said controllable opening and for additionally expanding the chamber volume at a faster rate than does the volume controlling means itself during an initial portion of the time said controlling means is expanding said chamber volume, whereby air is automatically purged from the chamber through said opening concurrently with filling the chamber with liquid through said passage.

8. A liquid dispensing device capable of purging air therefrom while being filled with liquid, comprising:

a main piston chamber of uniform cross-sectional shape therealong and having a first passage thereinto at one end thereof to enable fluid flow into and out of the chamber, a main piston of uniform cross-sectional shape therealong to mate with the main chamber shape and sealably connected to the piston chamber in a manner to be slideable therein, whereby to cause liquid to be drawn into and discharged from said main chamber through said first passage in response to movement of said piston away from or toward said first passage, respectively, a second passage into said chamber at another end thereof that is controllably opened and closed, means responsive to an initial segment of movement of said piston in the main chamber away from said first passage for simultaneously holding open said second passage and for expanding the piston chamber volume at a faster rate than does the main piston alone, said second passage remaining closed at all other positions of the main piston other than said initial segment, whereby air is purged from the main chamber through said second passage concurrently with an initial portion of a stroke of said main piston that draws liquid into the chamber through the first passage.

9. The liquid dispensing device according to claim 8 wherein said controllable second passage comprises means for breaking the seal between said main piston and said main piston chamber during said initial piston movement segment, and wherein said simultaneous holding and expanding means comprises a second piston of uniform cross-sectional shape therealong that is larger than said main piston and is held coaxially aligned with said main piston to move concurrently therewith in a second piston chamber to which said second piston is sealed during at least said initial main piston movement segment, said second chamber being in fluid communication with said first chamber through said second passage.

10. The liquid dispensing device according to claim 9 wherein said seal breaking means comprises a connecting segment holding said main and second pistons together, said segment having a cross-sectional dimension less than that of said main piston, said main piston forming a seal with said main chamber through a seal held by the main chamber, whereby said second passage is opened when said connecting piston segment is positioned within said main piston seal.

11. The liquid dispensing device according to claim 8 which additionally comprises means incrementally advancing said main piston toward said one piston chamber end for discharging through said passage a predetermined volume of liquid upon each piston incrementation without effect of said faster rate expanding means.

12. An improved dispensing device capable of automatically purging air therefrom while being filled with liquid, comprising:

a cylindrically shaped piston chamber, means provided at one end of said piston chamber for fluid to flow into and out of said chamber, a piston assembly, comprising:

a first elongated cylindrical piston segment at one end of said assembly having a diameter less than the internal diameter of said piston chamber for free reciprocation therein, and a second cylindrical piston segment of larger diameter axially connected to the first segment by a connecting portion that has a smaller cross-sectional extent than the first piston segment, a fluid sealing structure, comprising:

a first circular seal having a diameter for surrounding said first piston segment in a fluid tight manner, said seal being attached to another end of said piston chamber and axially aligned therewith, and a second circular seal having a diameter adapted to engage the outside surface of said second piston segment in a fluid tight manner, said second seal being held axially aligned with said first seal and said piston cylinder but a distance axially removed therefrom; said first and second seals being held with a fluid tight chamber therebetween except for the openings in said seals, said piston assembly being positioned for reciprocation in said piston cylinder and said sealing structure, said seals and said piston segments being relatively axially displaced from one another so that when the piston assembly is inserted a maximum amount towards said one end of the piston chamber that the second piston is within the second seal while said connecting segment of said piston is positioned within said first seal in a non-sealing relationship therewith, said seals and piston segments further being relatively axially displaced from one another so that as the piston is withdrawn from the piston chamber from its maximum inserted position the first piston segment makes its seal with said first seal before but substantially simultaneously with the second piston withdrawing from engagement with said second seal.

13. A pipette piston cylinder and seal construction that is detachable from a main pipette body for replacement or cleaning, comprising:

a unitary piston cylinder structure, comprising:

a first generally cylindrical portion defining a cylindrical piston chamber in its interior, said first portion terminating at one end thereof in an adaptor for connecting a tip thereto, said one end also including a fluid passage therethrough between one end of said piston cylinder and said tip connection for providing fluid communication between said chamber and an internal portion of the detachable tip, a second generally cylindrical portion having a significantly greater outside diameter than that of said first portion, one end of said second portion being integrally attached to another end of said first portion, thereby forming an abrupt discontinuity in the outside surface diameter of the structure, and a plurality of circular flange segments extending from a circular outside surface of said second piston cylinder structure at another end thereof with a common axis of both first and second cylindrical portions being the center of curvature of said flange segments, said flanges lying in a plane substantially perpendicular to said axis, and a piston sealing structure held within said second cylindrical portion of said unitary cylinder structure, said seal being made of a soft, resilient material and forming a first circular opening immediately adjacent another end of said piston chamber at the discontinuity between said first and second cylindrical portions of the cylindrical structure and a second circular opening adjacent said another end of the second cylindrical portion, said second opening having a significantly larger diameter than said first opening, thereby forming a structure that accepts a piston assembly having along its length distinct piston segments of different diameters.

* * * * *